US011898820B2

(12) United States Patent
Hindman et al.

(10) Patent No.: US 11,898,820 B2
(45) Date of Patent: Feb. 13, 2024

(54) TARGETING SYSTEM

(71) Applicant: Garmin Switzerland GmbH, Schaffhausen (CH)

(72) Inventors: Peter A. Hindman, Lawrence, KS (US); Chad A. VanCamp, Olathe, KS (US); Joe Ryan Dejmal, Shawnee, KS (US); Joseph T. Lunde, Olathe, KS (US); Robert P. Bernard, Olathe, KS (US)

(73) Assignee: Garmin Switzerland GmbH

( * ) Notice: Subject to any disclaimer, the term of this patent is extended or adjusted under 35 U.S.C. 154(b) by 280 days.

(21) Appl. No.: 17/452,878

(22) Filed: Oct. 29, 2021

(65) Prior Publication Data

US 2022/0205760 A1 Jun. 30, 2022

Related U.S. Application Data

(60) Provisional application No. 63/110,630, filed on Nov. 6, 2020.

(51) Int. Cl.

| | |
|---|---|
| ***F41G 1/467*** | (2006.01) |
| ***F41G 1/44*** | (2006.01) |
| ***F41G 1/30*** | (2006.01) |

(52) U.S. Cl.

CPC ..... *F41G 1/467* (2013.01); *F41G 1/30* (2013.01); *F41G 1/44* (2013.01)

(58) Field of Classification Search

CPC ..... F41G 1/467; F41G 1/30; F41G 1/44

See application file for complete search history.

(56) References Cited

U.S. PATENT DOCUMENTS

| | | | |
|---|---|---|---|
| 3,590,489 | A | 7/1971 | Saunders |
| 4,195,414 | A | 4/1980 | Robinson |
| 5,090,805 | A | 2/1992 | Stawarz |
| 5,425,177 | A | 6/1995 | Pacenti |
| 5,634,278 | A | 6/1997 | London |

(Continued)

OTHER PUBLICATIONS

Galileo Galilei, Two New Sciences, The MacMillan Company (1914, first published 1638).

(Continued)

*Primary Examiner* — Yaritza Guadalupe-McCall

(74) *Attorney, Agent, or Firm* — Samuel M. Korte; Max M. Ali

(57) ABSTRACT

A targeting system operable to be used with a bow to assist an operator with striking a target with a projectile. The targeting system comprising an accelerometer configured to generate acceleration data, an attitude sensor configured to generate attitude data, a display, a memory, and a processor. The processor is configured to profile steadiness using the acceleration data, profile roll using the attitude data, present on the display based on the steadiness profile one of an indication of unsteadiness represented by circular segments of relatively greater diameter with relatively greater unsteadiness, and an indication of steadiness represented by absence of the circular segments, and present on the display based on the roll profile one of an indication of level represented by at least one horizontal line and an indication of roll represented by at least one canted triangle and absence of the at least one horizontal line.

20 Claims, 13 Drawing Sheets

(56) References Cited

U.S. PATENT DOCUMENTS

| | | | | |
|---|---|---|---|---|
| 5,802,726 | A | 9/1998 | Trosper, Jr. et al. | |
| 5,836,294 | A | 11/1998 | Merritt | |
| 5,914,775 | A | 6/1999 | Hargrove et al. | |
| 6,073,352 | A | 6/2000 | Zykan et al. | |
| 6,079,111 | A | 6/2000 | Williams et al. | |
| 6,154,971 | A | 12/2000 | Perkins | |
| 6,397,483 | B1 | 6/2002 | Perkins | |
| 6,952,881 | B2 | 10/2005 | Mcgivern | |
| 7,603,804 | B2 | 10/2009 | Zaderey et al. | |
| 7,921,570 | B1 | 4/2011 | Pulkrabek et al. | |
| 8,286,871 | B2 * | 10/2012 | Bay | F41G 1/467 235/407 |
| 8,316,551 | B2 | 11/2012 | Gorsuch et al. | |
| 8,336,216 | B2 | 12/2012 | Samuels et al. | |
| 8,353,455 | B1 | 1/2013 | Huang | |
| 8,508,851 | B2 | 8/2013 | Miao et al. | |
| 8,739,419 | B1 | 6/2014 | Pulkrabek et al. | |
| 9,377,272 | B2 * | 6/2016 | Morrison | F41G 1/467 |
| 9,494,686 | B2 | 11/2016 | Maryfield et al. | |
| 9,677,849 | B2 * | 6/2017 | Morrison | F41G 1/467 |
| 10,670,372 | B2 * | 6/2020 | VanCamp | F41G 1/30 |
| 11,022,403 | B2 * | 6/2021 | VanCamp | F41G 3/323 |
| 11,306,993 | B2 * | 4/2022 | Bushman | G01P 3/685 |
| 2011/0222046 | A1 | 9/2011 | Overstreet | |
| 2011/0297744 | A1 | 12/2011 | Schneider et al. | |
| 2014/0331985 | A1 | 11/2014 | Samuels et al. | |
| 2015/0330742 | A1 * | 11/2015 | Overstreet | F41G 1/467 356/4.01 |
| 2015/0377588 | A1 | 12/2015 | Periard et al. | |
| 2016/0069640 | A1 | 3/2016 | Pretorius | |
| 2016/0202021 | A1 | 7/2016 | Roman et al. | |
| 2017/0051993 | A1 | 2/2017 | Imbriano et al. | |
| 2018/0335508 | A1 | 11/2018 | Lewis | |
| 2018/0347948 | A1 * | 12/2018 | VanCamp | F41G 1/30 |
| 2019/0101357 | A1 * | 4/2019 | VanCamp | F41G 3/323 |
| 2021/0262760 | A1 * | 8/2021 | VanCamp | F41G 3/08 |
| 2022/0196366 | A1 * | 6/2022 | Beckman | F41G 3/12 |
| 2022/0205760 | A1 * | 6/2022 | Hindman | F41G 1/467 |
| 2022/0236030 | A1 * | 7/2022 | Bushman | G01P 3/66 |

OTHER PUBLICATIONS

Gao Ying, The Way of Archery (first published in 1637), as translated in Jie Tan and Justin Ma, The Way of Archery: A 1637 Chinese Military Training Manual, Schiffer Publishing Ltd. (2014).

Horace Alfred Ford and W. Butt, The Theory and Practice of Archery, Longman, Greens, and Co. (1887).

Inter Partes Review No. IPR2018-01137 of U.S. Pat. No. 8,316,551, Declaration of Dr. Bill Cross, May 29, 2018.

Inter Partes Review No. IPR2018-01137 of U.S. Pat. No. 8,316,551, Petition for Inter Partes Review of U.S. Pat. No. 8,316,551B2, May 29, 2018.

International Search Report and Written Opinion from corresponding PCT/US2018/025865, filed Apr. 3, 2018.

Printout from http://bulletin.accurateshooter.com/2012/08/burris-expands-line-of-eliminator-laser-rangefinding-scopes/, published prior to Jun. 6, 2017.

Printout from http://www.digi-opto.com/BS.html, published prior to Jun. 6, 2017.

Printout from http://www.eotechinc.com/holographic-weapon-sights/model-512, published prior to Jun. 6, 2017.

Printout from http://www.eotechinc.com/holographic-weapon-sights/model-512-xbow, published prior to Jun. 6, 2017.

Printout from http://www.eotechinc.com/holographic-weapon-sights/model-xps2, published prior to Jun. 6, 2017.

Printout from http://www.eotechinc.com/sites/default/files/manuals/512%20HWS%20user%20Manual%202015%20Rev%20F.pdf; published prior to Jun. 6, 2017.

Printout from http://www.eotechinc.com/sites/default/files/manuals/XBow%20user%20manual%20supplement%20Rev%20F.pdf, published Jun. 2015.

Printout from http://www.eotechinc.com/sites/default/files/manuals/XPS2%20HWS%20user%20Manual%202015%20Rev%20F.pdf, published prior to Jun. 6, 2017.

Printout from https://en.wikipedia.org/wiki/Holographic_weapon_sight, published prior to Jun. 6, 2017.

Printout from https://guides.gamepressure.com/valorant/guide.asp?ID=54163 published prior to Oct. 29, 2021.

Printout from https://store.getavyd.com/, published prior to Jun. 6, 2017.

Printout from https://www.axionarchery.com/product/sight-level/ published prior to Oct. 29, 2021.

Printout from https://www.indiegogo.com/projects/bowranger-bow-hunting-range-finding-sight#/, published prior to Jun. 6, 2017.

Printout from https://www.leupold.com/rangefinders/hunting-rangefinders/vendetta-2-archery-rangefinder, published prior to Jun. 6, 2017.

Printout from https://www.precisionarrowplacement.com/ published prior to May 6, 2021.

U.S. Pat. No. 8,316,551, File History dated Nov. 9, 2009 to Nov. 7, 2012.

* cited by examiner

TARGETING SYSTEM

RELATED APPLICATION

The current patent application is a regular utility patent application which claims priority benefit, with regard to all common subject matter, to U.S. Provisional Application Ser. No. 63/110,630, filed Nov. 6, 2020, and entitled "IMPROVED TARGETING SYSTEM." The provisional application is incorporated by reference in its entirety into the current patent application.

BACKGROUND

Conventional projectile weapons, such as a bow, include or may be used with a sight that aids a user with identifying the target or a display (e.g., LCD, heads up display, etc.) that depicts an area associated with an intended target and presents a graphic element (e.g., crosshairs, dot, etc.). Some conventional bows include a sight that provides a recommended orientation of the bow to strike the desired target based on a determined range to the desired target, inclination, direction or speed of wind, velocity of an arrow, or various other targeting considerations. For example, the sight may indicate that a bow should be tilted up (pointing above the target) before an arrow is released in order to account for the impact of gravity on the arrow after its release from the bow while it is in flight towards the desired target.

BRIEF DESCRIPTION OF THE DRAWINGS

The detailed description references the accompanying figures. The use of the same reference numbers in different instances in the description and the figures may indicate similar or identical items. In addition, the proportion and the relative scale of the elements provided in the figures are intended to illustrate various embodiments of the present disclosure and are not to be used in a limiting sense.

DETAILED DESCRIPTION

Figure 1:
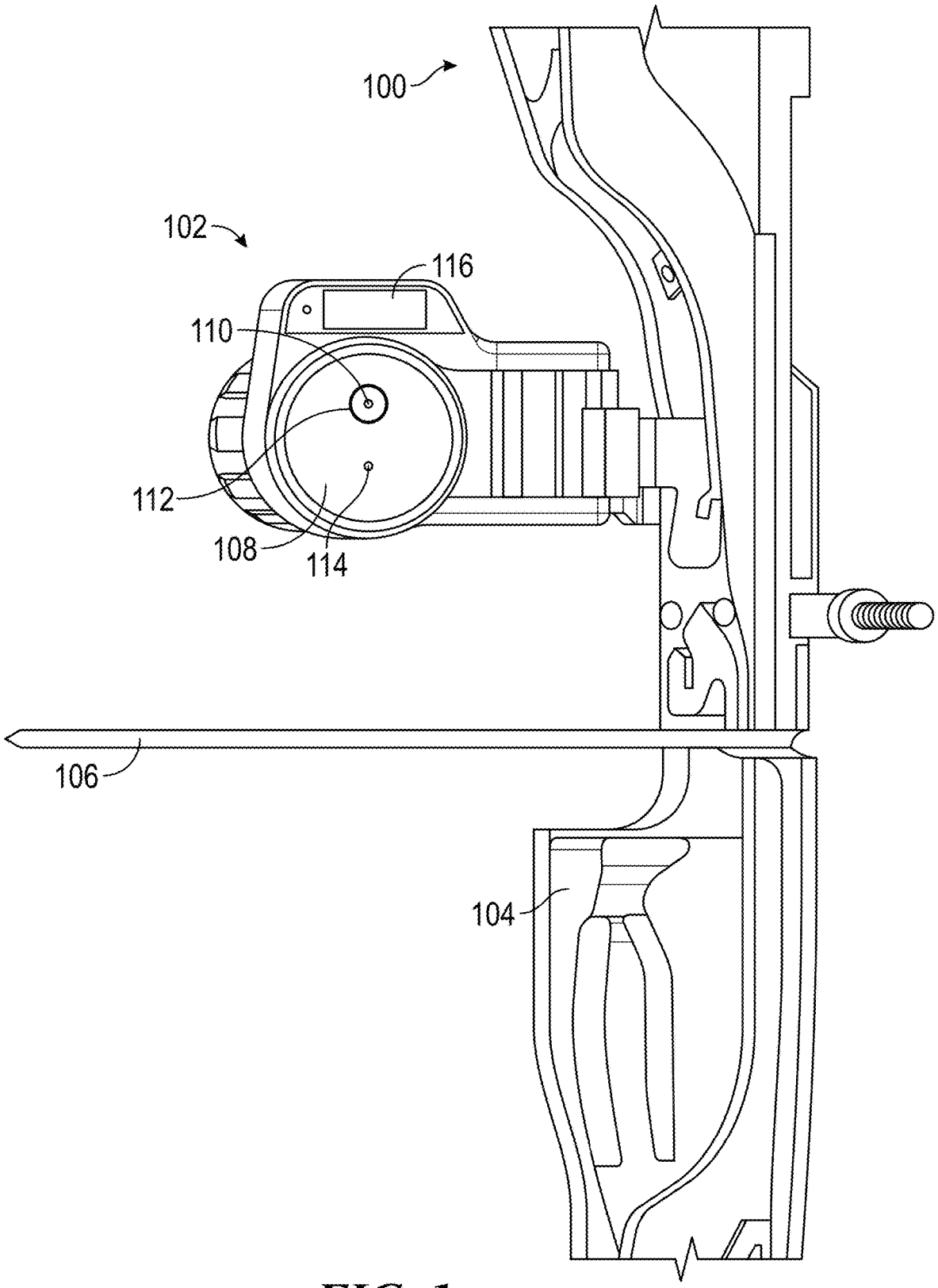
FIG. 1 is a perspective view of a targeting system secured to a bow.

The present disclosure includes targeting systems operable to be used with a bow. "Bow," as utilized herein, refers to any bow-type device including a recurve bow, a longbow, a compound bow, a crossbow, and/or other ranged archery device. The targeting system can include an accelerometer configured to generate acceleration data, an attitude sensor configured to generate attitude data, a display, a memory, and a processor. The processor can be configured to profile steadiness using the acceleration data, profile roll using the attitude data, present on the display based on the steadiness profile one of an indication of unsteadiness represented by circular segments of relatively greater diameter with relatively greater unsteadiness, and an indication of steadiness represented by absence of the circular segments, and present on the display based on the roll profile one of an indication of level represented by at least one horizontal line and an indication of roll represented by at least one canted triangle and absence of the at least one horizontal line.

Even with the use of a sight or a display on a bow, an operator can miss a target if the user does not hold the bow steady or if the bow is canted. Slight movement or rotation of the user in the fully drawn position may cause misalignment of the bow and result in errant ranging or shot of the arrow (or bolt in the case of a crossbow). For example, if the user is not holding the bow steady, the arrow could fly above, to the left, or to the right of the target. If the user is holding the bow canted, the arrow could miss to the left or right of the target. Therefore, determining and displaying whether the bow is level and/or steady can assist the operator with successfully striking the target.

The targeting system disclosed herein implements features and techniques to aid a user to adjust an orientation of the bow to successfully strike a target with an arrow (bolt, etc.). The targeting system may use acceleration data and attitude data of the targeting system to determine and present information on a display relating to an orientation of the bow. For instance, the presented information may include an indication of steadiness or an indication of unsteadiness based on a steadiness profile or an indication of level or an indication of roll based on a roll profile. Thus, embodiments of the targeting system aid an operator with determining whether to change the orientation of the bow and/or whether to release an arrow based on an indication of steadiness, unsteadiness, level, and/or roll presented on the display.

The targeting system may present on a display one or more indications for steadiness or unsteadiness. An indication of unsteadiness can be represented by circular segments. With greater unsteadiness, the diameter of the circular segments can increase. For example, a user may be notified by the circular segments that he is shaking and the user may try to reduce his shaking in response to seeing the circular segments. The user can verify that his shaking has lessened by the diameter of the circular segments.

If the user is steady (e.g., minimally shaking or not shaking) the circular segments may disappear from the display. This can indicate to the user that he is steady, which can reassure the user that he will not miss due to unsteadiness.

The targeting system may present on a display one or more indications for level or roll that are utilized to assist a user to successfully strike a target with an arrow or other projectile such as a crossbow bolt. An indication of roll can be represented by one or more canted triangles. As a user rolls the bow away from a zero-degree position (e.g., a level position), the one or more canted triangles have a greater offset from a horizontal axis. For example, if the bow is canted to the user's right, a first canted triangle on the user's left can be above a horizontal axis and a second canted triangle on the user's right can be below the horizontal axis. Accordingly, the user knows he must roll the bow to his left to get the bow to a level position. If the bow is canted to the user's left, the first canted triangle on the user's left can be below the horizontal axis and the second canted triangle on the user's right can be above the horizontal axis. As such, the user knows he must roll the bow to his right to get the bow to a level position.

In a number of embodiments, an indication of roll can be represented by a marker having an offset from center of a horizontal scale representing a roll angle of the targeting system. As the user rolls the bow away from a zero-degree position, the marker has a greater offset from the center of the horizontal scale. For example, if the bow is canted to the user's right, the marker is left of center of the horizontal scale. As the bow is rolled further to the user's right, the marker moves further left. The marker positioned left of center indicates to the user that he needs to roll the bow to the left to get the bow to a level position. If the bow is canted to the user's left, the marker is right of center of the horizontal scale. As the bow is rolled further to the user's left, the marker moves further right. The marker positioned right of center indicates to the user that he needs to roll the bow to the right to get the bow to a level position.

An indication of level can be represented by one or more horizontal lines. As the user rolls the bow into a zero-degree position, the one or more canted triangles can be replaced by one or more horizontal lines, which can signal to the user that the bow is in a level position.

In some examples, an indication of level can be represented by the marker being centered on the horizontal scale representing the roll angle of the targeting system. As the user rolls the bow into a zero-degree position, the marker moves towards the center of the horizontal scale, which can signal to the user that the bow is in a level position.

It should be appreciated that while the following disclosure refers to bows and other low-velocity projectile weapons, embodiments of the invention may be utilized with other types of weapons. In some exemplary embodiments of the invention, the targeting system interacts with a firearm, a grenade launcher, artillery and other large projectile weapons, a missile, a rocket, a torpedo, or a weapon associated with a vehicle (such as an aircraft, a ship, a tank, an armored personnel carrier, a mobile artillery piece, or the like). It should therefore be noted that throughout the description, "bow" may be replaced by "projectile weapon" or any of the above-mentioned examples; "arrow" may be replaced by "projectile" or any projectile associated with the above-mentioned examples; and "operator" could be replaced with "user," "hunter," "gunner," "shooter," "driver," or the like.

FIG. 1 is a perspective view of a targeting system 102 secured to a bow 100. Embodiments of the invention may be used in an environment of bow 100. As described above, bow 100 may be a crossbow, a long bow, a recurve bow, or a compound bow. However, embodiments of the present invention may be employed with any projectile weapon. As illustrated in FIG. 1, in some embodiments, bow 100 may be a compound bow. FIG. 1 shows a bow 100 with a targeting system 102 thereon, as seen from an operator's perspective (with a target positioned on the opposite side of bow 100 and targeting system 102).

The targeting system 102 may be mounted to the bow 100 above an arrow rest 104 and arrow 106. Targeting system 102 contains a transparent or semi-transparent target sighting window 108. An object to be targeted using targeting system 102 is seen by a user through target sighting window 108. The target sighting window 108 enables a processor of targeting system 102 to present or display one or more sighting marks (such as a fixed sighting mark 110, a laser sighting reticle 112, and a variable compensated sighting mark 114, each of which is discussed in depth below) used for calibration of targeting system 102 and the targeting of an object of interest. The processing system may calibrate the targeting system 102 and determine an orientation of the bow 100 to strike a target with an arrow 106 based on a determined range to the object and information from sensors (e.g., an inclinometer, a gyroscope, etc.). The targeting system 102 includes a ranging module 410. In embodiments, the targeting system 102 may further include an alphanumeric display 116 for the display of information to the operator, as discussed below. Display 116 may be integrated with, or placed upon, the target sighting window 108 in some configurations.

The target sighting window 108 is substantially transparent, with a reflective layer such that it is operable to allow light to pass through to observe the target 218 and to direct a targeting projection to the operator. As discussed more below, the surface of the target sighting window 108 may be partially reflective (for example, within a range of 10-50%), polarized, and/or may incorporate a narrow-band reflectivity to enhance the visibility of the various projected reticles. The projector is operable to project onto the target sighting window 108 a fixed sighting mark 110 and/or a laser sighting reticle 112 that substantially aligns line of sight 208 to the ranging module transmit axis 212. The projector is further operable to project a variable compensated sighting mark 114 onto the target sighting window 108. The variable compensated sighting mark 114 is associated with a compensated targeting axis 210, which is determined at least in part based upon the range indication. In embodiments, the color of the variable compensated sighting mark 114 may be the same color as the fixed sighting mark 110 or the variable compensated sighting mark 114 may be a different color to increase visibility of the variable compensated sighting mark 114.

Targeting system 102 may include, in embodiments, a projector housing 406 enclosing a processor, a memory, a ranging module 410, an inclinometer, an accelerometer, a battery, and other components.

Figure 4:
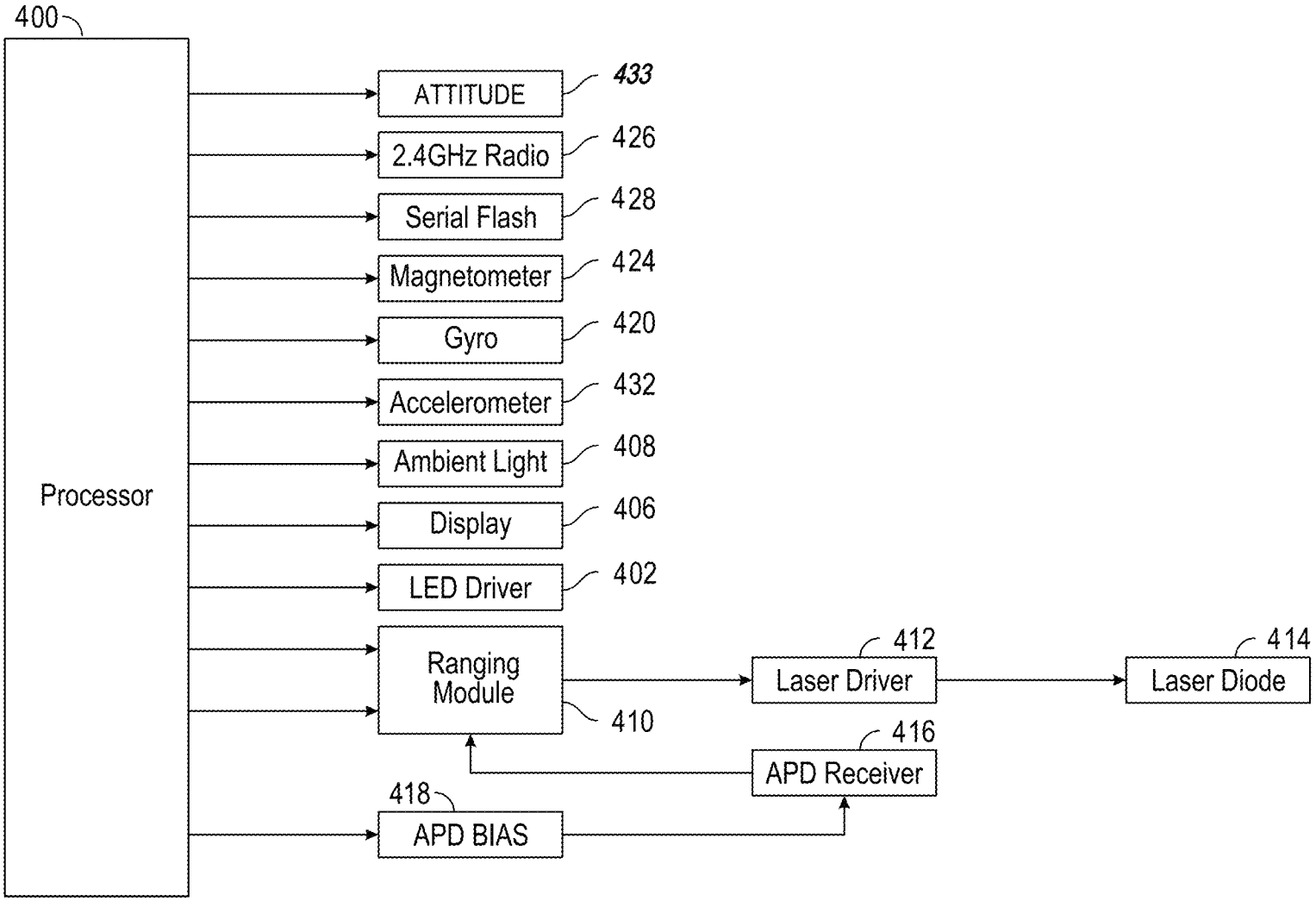
FIG. 4 is a block hardware diagram illustrating exemplary electronic components of the targeting system.

The targeting system 102 may include a processor (which may be the microcontroller illustrated in FIG. 4). The processor provides processing functionality for the targeting system 102 and may include any number of processors, micro-controllers, or other processing systems, and resident or external memory for storing data and other information accessed or generated by the targeting system 102. To provide examples, the processor may be implemented as an application specific integrated circuit (ASIC), an embedded processor, a central processing unit associated with targeting system 102, etc. The processor may execute one or more software programs that implement the techniques and modules described herein. The processor is not limited by the materials from which it is formed or the processing mechanisms employed therein and, as such, may be implemented via semiconductor(s) and/or transistors (e.g., electronic integrated circuits (ICs)), and so forth.

It is to be understood that the processor of targeting system 102 may be implemented as any suitable type and/or number of processors. For example, the processor may be a host processor of targeting system 102 that executes functions and methods relating to the information presented on target sighting window 108 as well as functions and methods relating to ranging module 410. It should also be appreciated that the discussed functions and methods performed by the processor of the targeting system 102 may be performed by the processor of the ranging module 410. In embodiments, ranging module 410 includes a separate processor and the described structure of the processor may also describe corresponding structure on the processor of the ranging module 410.

The targeting system 102 may also include a communications element (not illustrated) that permits the targeting system 102 to send and receive data between different devices (e.g., the ranging module 410, the inclinometer, other components, peripherals, and other external systems) and/or over the one or more networks. The communications element includes one or more Network Interface Units. NIU may be any form of wired or wireless network transceiver known in the art, including but not limited to networks configured for communications. Wired communications are also contemplated such as through universal serial bus (USB), Ethernet, serial connections, and so forth. Targeting system 102 may include multiple NIUs for connecting to different networks or a single NIU that can connect to each necessary network.

The targeting system 102 may also include a memory (not illustrated). The memory is an example of device-readable storage media that provides storage functionality to store various data associated with the operation of the targeting system 102, such as the software program and code segments discussed below, or other data to instruct the processor and other elements of the targeting system 102 to perform the techniques described herein. A wide variety of types and combinations of memory may be employed. The memory may be integral with the processor, a stand-alone memory, or a combination of both. The memory may include, for example, removable and non-removable memory elements such as RAM, ROM, Flash (e.g., SD Card, mini-SD card, micro-SD Card), magnetic, optical, USB memory devices, and so forth. In embodiments of the targeting system 102, the memory may include removable ICC (Integrated Circuit Card) memory such as provided by SIM (Subscriber Identity Module) cards, USIM (Universal Subscriber Identity Module) cards, UICC (Universal Integrated Circuit Cards), and so on.

The targeting system 102 may also comprise an inclinometer operable to determine an inclination of a ranging module transmit axis 212 relative to horizontal (e.g., relative to an artificial horizon). The compensated targeting axis 210 is determined at least in part by a horizontal component to the range indication. As the target 218 may be above or below targeting system 102 and its ranging module 410, the range indication can be expressed as a vertical component and a horizontal component (being the vertical and horizontal sides of a right triangle, with a line from the ranging module 410 to the target 218 being the hypotenuse). As the force of gravity affects travel in the horizontal direction, only the horizontal component (or some associated ratio) may be used in calculating the compensated targeting axis 210.

The targeting system 102 may also comprise an accelerometer (illustrated schematically in FIG. 4) operable to detect a shot from the bow 100. The accelerometer detects accelerations or other motion of the targeting system 102. If the detected acceleration is above a certain threshold, the accelerometer (or the processor) may process a shot. The determination that the operator has shot the bow 100 may then be used for various purposes. For example, during the calibration process the processor may prompt the user, via the alphanumeric display 116, to input whether the arrow 106 struck the target 218 and/or any targeting error between the sighted point and the impact point. As another example, following the calibration process, the processor may instruct the projector 600 to turn off the variable compensated sighting mark 114.

The targeting system 102 may also comprise an ambient light sensor (illustrated schematically in FIG. 4) operable to detect an ambient light level at the bow 100. A characteristic of the variable compensated sighting mark 114 is determined by the ambient light level (or more specifically, determined by an ambient light reading from the ambient light sensor). Characteristics of the variable compensated sighting mark 114 that may change include a brightness level, a color, a shape or a size, or other visual characteristic. The characteristic is changed such that the operator can still see the variable compensated sighting mark 114 as well as the target 218 without the variable compensated sighting mark 114 being too obtrusive. For example, in low light scenarios, a smaller and/or dimmer variable compensated sighting mark 114 will allow the operator to observe both the variable sighting mark 114 and the target 218. The variable compensated sighting mark 114 may also be in the red spectrum so as to reduce night blindness in the operator. In brightly lit scenarios, a larger and/or brighter variable compensated sighting mark 114 may be used to ensure that the operator can see the variable compensated sighting mark 114. In embodiments of the invention, the changing of the characteristic is performed without operator input (e.g., the processor selects the characteristics of the variable compensated sighting mark 114 without prompting the operator). The operator may additionally or alternatively be provided with a selection for the variable compensated sighting mark 114 (for example, the operator may indicate that a brighter variable compensated sighting mark 114 is generally desired by the operator, or that the operator prefers the variable compensated sighting mark 114 to be a certain color).

In embodiments of the invention, the targeting system 102 includes an alphanumeric display 116 to present information to the operator. In embodiments, the alphanumeric display 116 may comprise an LCD (Liquid Crystal Diode) display, a TFT (Thin Film Transistor) LCD display, an LEP (Light Emitting Polymer) or PLED (Polymer Light Emitting Diode) display, an OLED (Organic Light-Emitting Diode), and so forth, configured to display text and/or graphical information such as a graphical user interface. The alphanumeric display 116 could also be a three-dimensional display, such as a holographic or semi-holographic display. The alphanumeric display 116 may be backlit via a backlight such that it may be viewed in the dark or other low-light environments, as well as in bright sunlight conditions. Target sighting window 108 may be integrated with, or formed by, one or more of the foregoing display 116 elements.

The alphanumeric display 116 may be provided with a screen for presentation of information and entry of data and commands. In one or more implementations, the screen comprises a touch screen. For example, the touch screen may be a resistive touch screen, a surface acoustic wave touch screen, a capacitive touch screen, an infrared touch screen, optical imaging touch screens, dispersive signal touch screens, acoustic pulse recognition touch screens, combinations thereof, and the like. Capacitive touch screens may include surface capacitance touch screens, projected capacitance touch screens, mutual capacitance touch screens, and self-capacitance touch screens. The alphanumeric display 116 may therefore present an interactive portion (e.g., a "soft" keyboard, buttons, etc.) on the touch screen. In some embodiments, the alphanumeric display 116 may also include physical buttons integrated as part of targeting system 102 that may have dedicated and/or multipurpose functionality, etc. In other embodiments, the alphanumeric display 116 includes a cursor control device (CCD) that utilizes a mouse, rollerball, trackpad, joystick, buttons, or the like to control and interact with the alphanumeric display 116.

Figure 2:
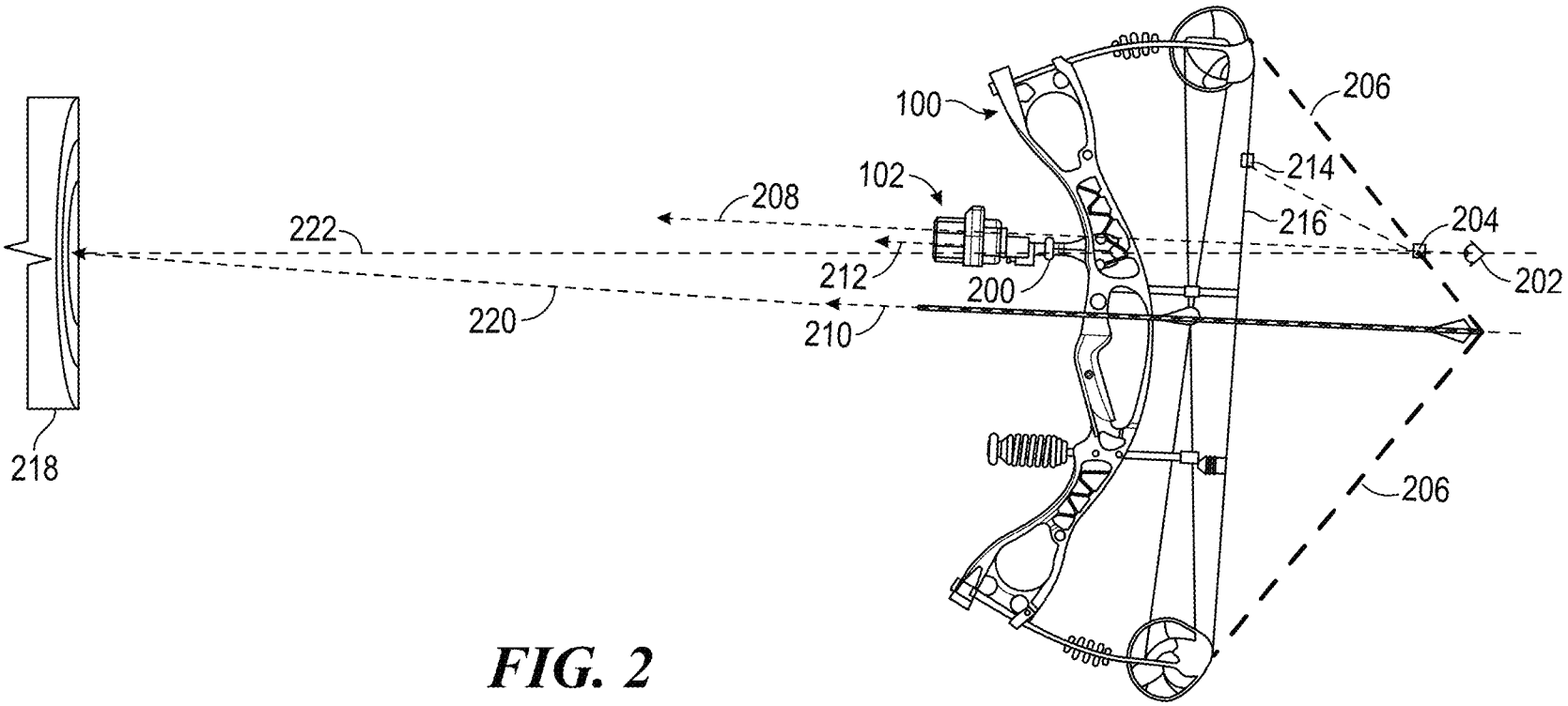
FIG. 2 is a side view of the targeting system and bow, illustrating a compensated targeting axis to a target.

FIG. 2 is a side view of the targeting system 102 and bow 100, illustrating a compensated targeting axis to a target. FIG. 2 shows a side view of the bow 100 in both drawn and undrawn positions. A bow string 206, 216 provides an exemplary form of propulsion for arrow 106. Bow string 206 corresponds to bow 100 in the fully drawn position where bow string 206 and arrow 106 have been pulled by the user to an anchor point. Bow string 216 corresponds to bow 100 when in the undrawn position.

The targeting system 102 is aligned with bow 100 or positioned in front of bow 100 using the attachment arm 200. The attachment arm 200 places the targeting system 102 approximately 0.6 to 0.8 meters from an eye position 202 of the user when bow 100 is drawn.

In some embodiments, such as bow 100 being a compound bow, a peep sight 204 is attached to or incorporated within bow string 206. The peep sight 204 forms a small, circular opening through which the target scene and target sighting window 108 are viewed by the user from eye position 202. A line of sight 208 extends from eye position 202, through peep sight 204, through the target sighting window 108, to a target 218 while bow 100 is in the drawn position. Movement of peep sight 204 attached to bow string 206 from an undrawn initial position 214 to a drawn position is illustrated using a broken line.

To help illustrate use of targeting system 102, axes are described herein only for illustrative purposes. It is to be understood that two or more of the axis may be directed in the same direction at some moments in time and each axis may be directed in different directions at other moments in time. A first axis, a line of sight 208, extends from eye position 202 through the target sighting window 108 to a target 218. When bow 100 is in the drawn position, line of sight 208 extends through peep sight 204. A second axis, a compensated targeting axis 210, corresponds to a trajectory of the arrow 106 after release. A third axis, a ranging module transmit axis 212, corresponds to the beam output from ranging module 410 towards target 218.

It is to be understood that FIG. 2 is not drawn to scale, but the compensated targeting axis 210 is generally illustrative of an initial inclination of the trajectory of the arrow 106 after release, and is generally aligned with (e.g., parallel to) a ranging module transmit axis 212 (discussed below). The arrow 106 follows a trajectory 220 through the air to a desired point on target 218. For instance, if arrow 106 travels a significant distance from bow 100 to reach a target 218 located at a similar height as bow 100, trajectory 220 rises to an apex before gravity and air resistance cause the arrow 106 to descend to the target 218. It should therefore be appreciated that a compensated targeting axis 210 may be raised such that arrow 106 is aiming above the target 218. The compensated targeting axis 210 is the axis in which the arrow 106 travels initially upon leaving the bow 100. For a target 218 located at a similar height to bow 100, the compensated targeting axis 210 is typically above a target sight line 222 extending from eye position 202 to the target 218, such that (from the operator's perspective) the trajectory 220 of arrow 106 appears to be above the target 218. The location of variable compensated sighting mark 114, as discussed in depth below, is determined by the processor to enable the operator to orient bow 100 such that the variable compensated sighting mark 114 is placed onto a location of the desired target 218 (by viewing target 218 through the target sighting window 108).

In embodiments, the targeting system 102 comprises a ranging module 410, a target sighting window 108, and a projector. The ranging module 410 is operable to determine a range to a target 218 and has an associated ranging module transmit axis 212 along which a beam is transmit to the target 218 (a reflection of the beam from target 218 may follow the same path).

In some embodiments of the invention, the targeting system 102 may be integrated into the bow 100. In other embodiments of the invention, the targeting system 102 is a standalone device that is secured to the bow 100. In still other embodiments of the invention, the targeting system 102 is a standalone device that may additionally or optionally interface with other external devices (such as a bow camera, a smart phone, a location element, or other device).

Figure 3:
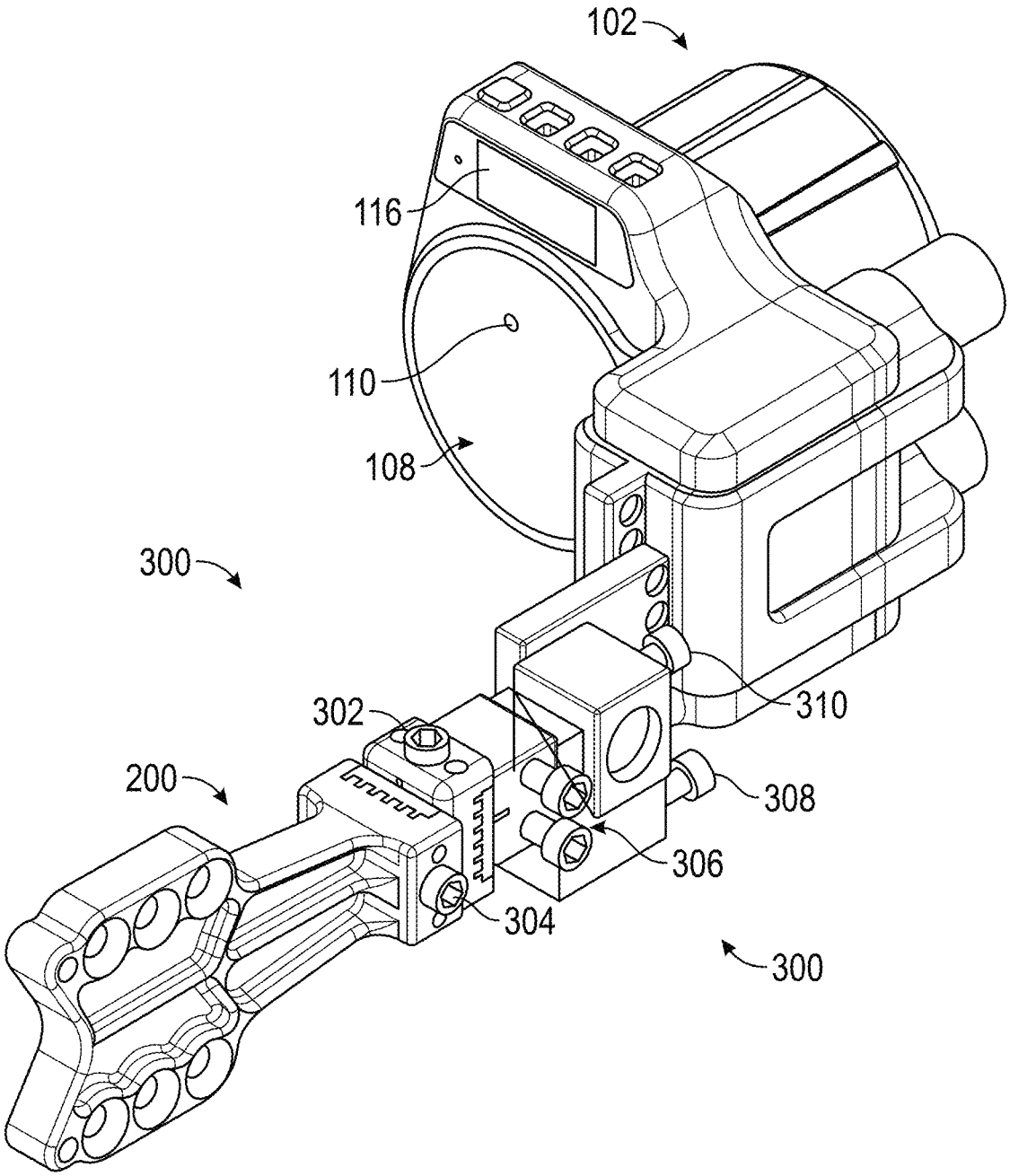
FIG. 3 is a perspective view of the targeting system, illustrating an attachment arm operable to be adjusted to align the targeting system with the bow.

FIG. 3 is a perspective view of the targeting system 102, illustrating an attachment arm operable to be adjusted to align the targeting system 102 with the bow 100. FIG. 3 shows the targeting system 102 detached from the bow 100. The targeting system 102 may include target sighting window 108 as well as various sensors and circuitry to calculate a range from bow 100 to a target 218, determine an orientation of bow 100, or environmental conditions (e.g., wind sensor, ambient light sensor, etc.). Targeting system 102 may include a housing formed from a unitary assembly or combined in a semi-permanent configuration containing the components of targeting system 102.

As discussed below, the operator may align the targeting system 102 such that the fixed sighting mark 110 such that line of sight 208 intersects (coincides with) ranging module transmit axis 212 at a certain distance when target sighting window 108 is viewed from a perspective corresponding to eye position 202. A line of sight 208 and ranging module transmit axis 212 are separated by a predetermined distance (e.g., 1-2 inches) and originate from eye position 202 and beam source 508, respectively. The separation between line of sight 208 and ranging module transmit axis 212 is identified by reference "D." Therefore, fixed sighting mark 110 enables a user to ensure that the target being aimed towards from eye position 202 corresponds to the beam output from ranging module 410 for accurately ranging the target 218. The attachment arm 200 therefore may be operable to be adjusted by the operator to provide this alignment of line of sight 208 and ranging module transmit axis 212. Such proper alignment is confirmed and adjusted as needed during the calibration process. The attachment arm 200 may be adjusted in a variety of manners to enable proper use of targeting system 102 with bow 100. For instance, the attachment arm 200 may include translation adjustments, angle elevation adjustments (which may be referred to as "pitch"), azimuth adjustments (which may be referred to as "yaw), and/or rotation adjustments (which may be referred to as "roll").

The attachment arm 200 may include or couple to an alignment mechanism 300 that provides translation of the targeting system 102 in elevation and azimuth to align a fixed sighting dot to the ranging module transmit axis 212 as well as the nominal trajectory 220 of the arrow 106. Exemplary components of the alignment mechanism 300, such as those for rack and pinion elevation 302 and azimuth adjustments 304 are shown. Further examples could include a rotational adjustment 306, which provides rotation or roll of the targeting system 102. A yaw sight adjustment 308 moves the targeting system 102 in a yaw direction, and a pitch sight adjustment 310 moves the targeting system 102 in the pitch direction. It should be appreciated that these adjustments are made relative to the bow 100 on which the attachment arm 200 is mounted.

FIG. 4 is a block hardware diagram illustrating exemplary electronic components of the targeting system 102. It should be appreciated that, like other figures discussed herein, the block diagram is only exemplary to aid in the understanding by the reader. The targeting system 102 includes a processor 400 (which may be itself or may be associated with the above-discussed processor) supporting a mix of serial buses and programmable logic standards. Both the light array and the projector engine are driven by current-controlled LED driver 402 under the control of general purpose IO's and pulse width modulation (PWM) outputs for brightness control. A trans-reflective LCD display 406 (associated with the alphanumeric display 116) may contain a sub-processor to reduce main processor 400 loading and communications requirements.

The display 406 can be a high resolution digital light processing (DLP) display that can be integrated into the targeting system 102 that can also include hardware such as a three-axis compass, a barometric altimeter, an accelerometer 432, and/or a global navigation satellite system (GNSS) receiver to provide features that traditional aiming devices, range finders, and scouting optics (e.g., monocular, binoculars, spotting scopes, and telescopes) do not. These features may include detecting cant, wind, shots fired, and/or steadiness.

Cant can cause poor downrange accuracy in not only the horizontal plane but also in the vertical plane. Cant can be detected using an accelerometer and the targeting system 102 can show on the display 406 the point of impact of the arrow if the cant is not corrected before a shot is taken.

Wind can also cause horizontal and vertical deviation from an intended point of impact if wind wasn't present. Users can shoot/calibrate in known cross, head, and/or tail winds, and save those points of impact to memory. The user can then "recall" a profile based on wind settings that they input, which can adjust their aiming references to achieve their desired point of impact in that type of wind. In a number of embodiments, the wind and cant features can be combined into one aiming reference, which could show in real time the arrow 106 impact based on wind and cant if those variables are not accounted for.

An ambient light sensor 408 measures the light levels of the target scene to allow adaptive brightness control of the targeting LEDs and the activation of the display 406 backlight under darker conditions, as discussed above. In a number of embodiments, the processor 400 can receive ambient light data from the ambient light sensor and determine to show particular indicators in particular shades or colors to contrast against a background including the target scene presented on the display 406.

The ranging module 410 includes a laser driver 412, single mode or pulsed laser diode 414 (all associated with a beam source) as well as a receiver 416 (associated with a beam receptor, such as an avalanche photodiode (APD) receiver). In embodiments, a portion of processor 400 and a memory of the targeting system 102 may be located within ranging module 410.

Processor 400 may determine a range (distance) to a target based on a calculated delay between a transmission of a coded burst code and the reception of a reflected transmission and subsequent correlation of the received signal against a stored transmit signature corresponding to the transmitted signal. The laser diode 414 offers a precise measurement beam with a divergence under a minimum threshold (for example, under 1 milli-radian). Bias supply 418 (e.g., APD bias) provides a regulated high voltage output controlled by the microcontroller 400 based on inputs of the system noise floor as measured by the processor 400 and a temperature sensor. Solid-state gyro 420 (being an inclinometer) provides bow inclination information, which is used to calculate the required elevation offset based on calculations for arrow drop when combined with target range.

Accelerometer 432 is used to monitor bow rotational dynamics during a shot which can be used to detect incorrect firing technique of the operator, to detect release of arrow 106, and to detect unsteadiness or steadiness of the targeting system 102. The accelerometer 432 can generate acceleration data of the targeting system 102 and transmit the acceleration data to the processor 400. The processor 400 can receive the acceleration data and profile steadiness of the targeting system 102 using the acceleration data. The processor 400 can transmit a command to the display 406 to present an indication of unsteadiness or steadiness based on the steadiness profile.

How steady a user was at the time of a shot is critical to a successful point of impact of an arrow 106. The accelerometer 432 in the targeting system 102 can be used to profile steadiness and cant of a bow before, during, and immediately after a shot. This data can help a user to improve their shooting form and detect when a missed point of impact was due to a lack of shooting stability or faulty equipment, such as a cam out of manufacturer timing on the bow 100 or an incorrectly spined arrow 106.

In a number of embodiments, a shot can be detected by the processor 400 using the acceleration data. Gravitational force can be measured by the accelerometer 432. When the gravitational forces measured by the accelerometer 432 exceed a certain level, the processor 400 can determine a shot was taken. The processor can record a number of shots taken based on the acceleration data and transmit a command to the display 406 to present the number of shots taken. In some examples, the processor can notify a user in response to the number of shots taken reaching a threshold number of shots by transmitting a command to the display 406 to present a message that a threshold number of shots has been reached. A user can specify the threshold number of shots and/or the threshold number of shots can be based on the number of shots that can be taken until a bow string 206, 216 needs to be replaced. Due to the forces involved in shooting an arrow, most bow (e.g., crossbow) manufacturers recommend replacing the bow's string 206, 216 after a certain number of shots. Rather than keep track of the number of times the bow 100 has been shot manually, the targeting system 102 can record shots automatically and notify the user when the customer specified shot counter is close to or has exceeded the number of shots for string replacement.

Magnetometer 424 performs functions as a digital compass, in conjunction with the gyro 420 and the measured distance from the ranging module 410 can provide heading, distance and inclination to a target 218. This information, when combined with the capability to transmit the data to a GPS-enabled smart phone using communication element 426 operating using any of various wireless standards (such as BLUETOOTH or the low-power ANT wireless standard). The communication element also allows the logging or forwarding of the location of the target 218 to an external system (for example, to mark the target location on a map for later inspection by the operator). Serial flash 428 can be used to store user programmed parameters, software downloads and the storage of a history of operation for later review.

One or more attitude sensors 433 can be included in the targeting system 102 and be coupled to processor 400. An attitude sensor 433 can generate attitude data including roll, pitch, and/or yaw of the targeting system 102 and transmit the attitude data to the processor 400. The processor 400 can receive the attitude data and profile roll of the targeting system 102 using the attitude data. The processor 400 can transmit a command to the display 406 to present an indication of level or roll based on the roll profile. In some examples, the processor 400 can determine a particular roll angle or a particular roll angle range of the targeting system 102 and transmit a command to the display 406 to show a numerical degree value of the roll angle or roll angle range of the targeting system 102.

Figure 5:
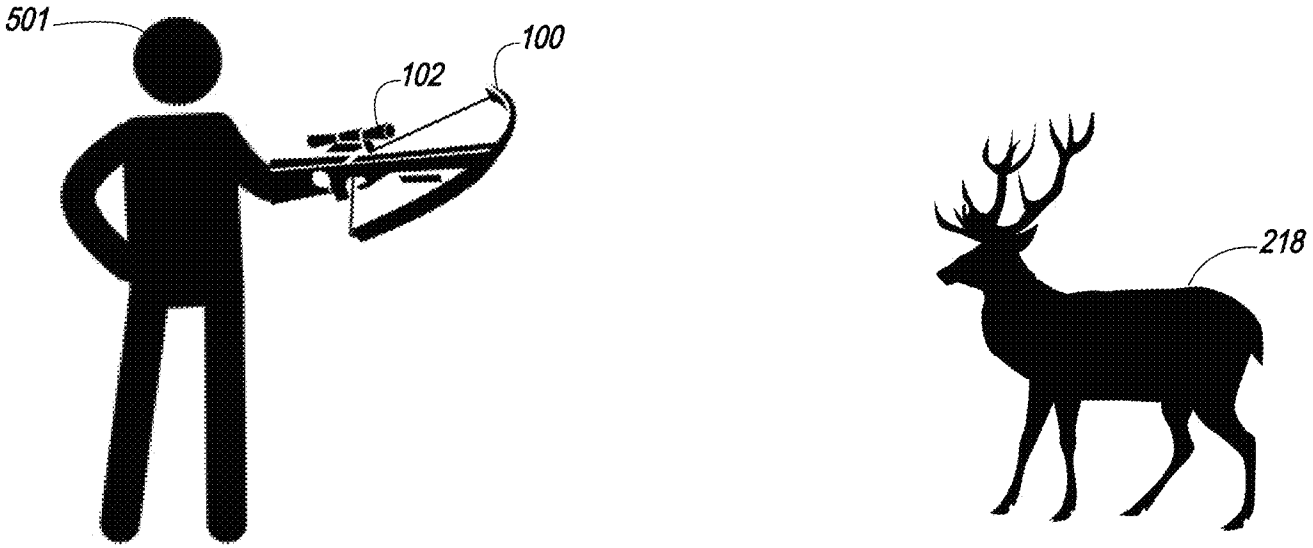
FIG. 5 illustrates an example of a user using the targeting system secured to a bow.

FIG. 5 illustrates an example of a user (e.g., operator) 501 using the targeting system 102 secured to a bow 100. Bow 100, as illustrated in FIG. 5 can be a crossbow. FIG. 5 shows a bow 100 with a targeting system 102 thereon, as seen from a side view with the bow 100 pointed at a target 218, which is a deer in this example.

Figure 6A:
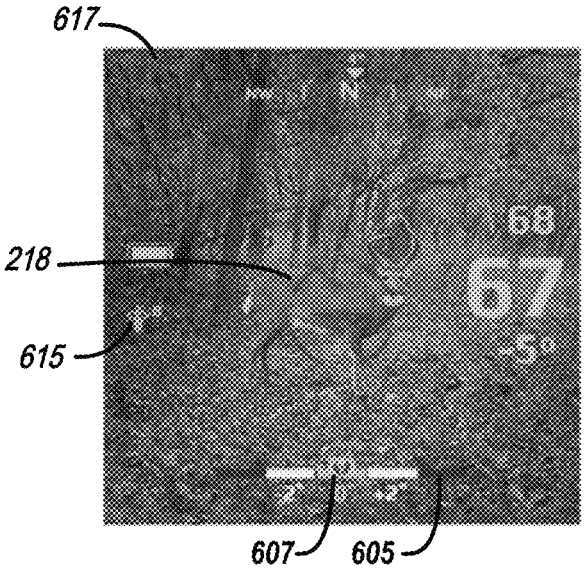
FIG. 6A illustrates an example of a user interface of the targeting system including an indication of level.

FIG. 6A illustrates an example of a user interface 617 of the targeting system 102 including an indication of level. The user interface 617 can display the target 218, a horizontal scale 605 and a marker 607 representing a roll angle of the targeting system 102, and a numerical value representing a number of shots taken 615, among other indicators. In some examples, the horizontal scale 605 and the marker 607 can be an additional indication of level or roll if the user interface 617 includes another indication of level or roll.

A user 501 can have right or left misses if the targeting system 102 is canted. Therefore, determining and displaying whether the targeting system 102 is level via the horizontal scale 605 and the marker 607 can assist the operator with successfully striking the target 218. An indication of level can be represented by the marker 607 being centered on the horizontal scale 605, as illustrated in FIG. 6A. As the user 501 rolls the targeting system 102 into a zero-degree position, the marker 607 can move towards the center of the horizontal scale 605, which can signal to the user 501 that the targeting system 102 is in a level position.

In some examples, the user interface 617 can display a numerical indication of degrees of roll. As illustrated, in FIG. 6A, three numerical indications of degrees of roll, −2°, 0°, and +2°, are presented under the horizontal scale 605. The marker 607 is positioned on the horizontal scale 605 above 0°, indicating to the user 501 that the targeting system 102 has zero degrees of roll.

A number of sections of roll angle ranges can be included on the horizontal scale 605. The number of sections of roll angle ranges can be represented by shades or colors. For example, 0° of roll can be displayed in grey, −2° and +2° of roll can be displayed in white, and degrees of roll outside of the range of −2° to +2° can be displayed in black, as illustrated in FIG. 6A.

In a number of embodiments, the user interface 617 can display the number of shots taken 615. The number of shots taken 615 can be a numerical indicator, as illustrated in FIG. 6A, as "8". When the number of shots taken reaches a threshold number of shots, the user 501 can be notified. For example, the user interface 617 can display a message.

Figure 6B:
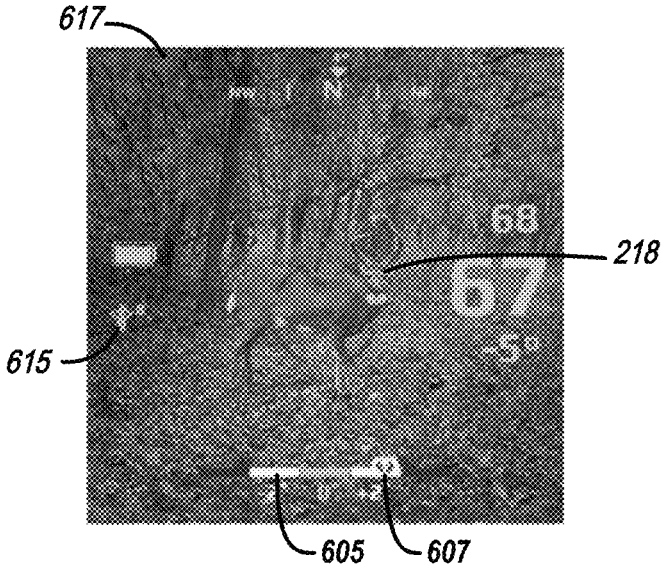
FIG. 6B illustrates an example of a user interface of the targeting system including an indication of roll.

FIG. 6B illustrates an example of a user interface 617 of the targeting system 102 including an indication of roll. The indication of roll can be represented by marker 607 having an offset from center of the horizontal scale 605 representing roll angle of the targeting system 102. The marker 607 has a relatively greater offset from center with relatively greater roll on the horizontal scale 605. For example, if the targeting system 102 is canted to the user's left, the marker 607 is right of center of the horizontal scale 605. As the targeting system 102 is rolled further to the user's left, the marker 607 moves further right on the horizontal scale 605. The marker 607 positioned right of center on the horizontal scale 605, indicates to the user 501, that he needs to roll the targeting system 102 to the right to get the targeting system 102 to a level position. In FIG. 6B, the marker 607 is positioned on the horizontal scale 605 above +2°, indicating to the user 501 that the targeting system 102 has two degrees of roll.

Figure 6C:
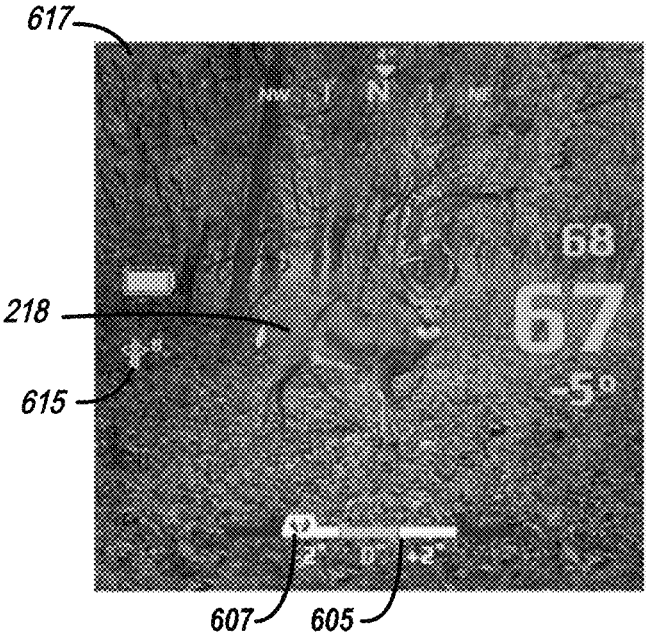
FIG. 6C illustrates an example of a user interface of the targeting system including an indication of roll.

FIG. 6C illustrates an example of a user interface 617 of the targeting system 102 including an indication of roll. The indication of roll can be represented by marker 607 having an offset from center of the horizontal scale 605 representing roll angle. For example, if the targeting system 102 is canted to the user's right, the marker 607 is left of center of the horizontal scale 605. As the targeting system 102 is rolled further to the user's right, the marker 607 moves further left on the horizontal scale 605. The marker 607 positioned left of center indicates to the user 501 that he needs to roll the targeting system 102 to the left to get the targeting system 102 to a level position. In FIG. 6C, the marker 607 is positioned on the horizontal scale 605 above −2°, indicating to the user 501 that the targeting system 102 has negative two degrees of roll.

Figure 7A:
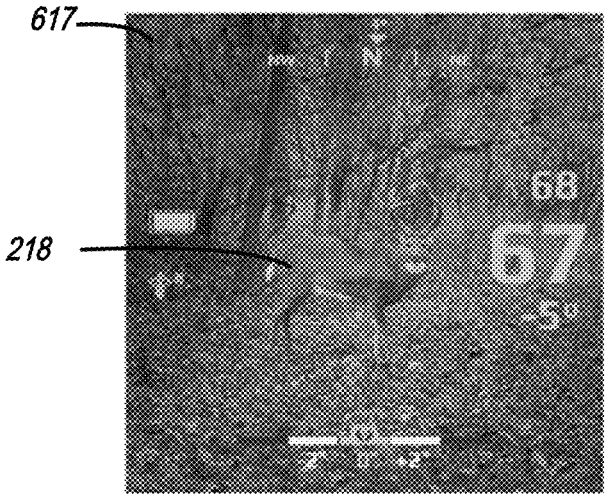
FIG. 7A illustrates an example of a user interface of the targeting system including an indication of steadiness.

FIG. 7A illustrates an example of a user interface 617 of the targeting system 102 including an indication of steadiness. Even with the use of a sight or a display on a targeting system 102, an operator can miss a target 218 if the user 501 does not hold the targeting system 102 steady. Slight movement or rotation of the user 501 in the fully drawn position may cause misalignment of the bow and result in errant ranging or shot of the arrow 106. Therefore, determining and displaying whether the targeting system 102 is steady can assist the operator with successfully striking the target 218.

A user 501 can know if their targeting system 102 is steady by the absence of indicators of unsteadiness. For example, if the user interface 617 does not show circular segments, as illustrated in FIG. 7A, the targeting system 102 is steady. The targeting system 102 can be steady when a user 501 is minimally shaking or not shaking. The absence of indicators of unsteadiness on the user interface 617 may reassure the user 501 that they are steady and will not miss due to unsteadiness.

Figure 7B:
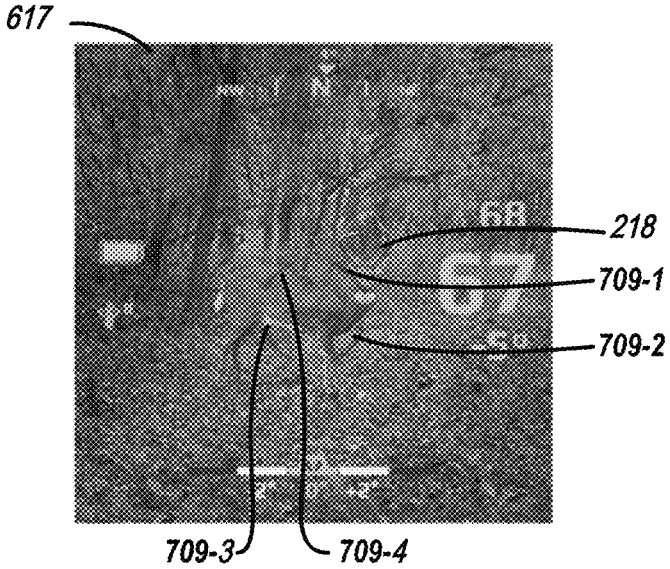
FIG. 7B illustrates an example of a user interface of the targeting system including an indication of unsteadiness.
Figure 7C:
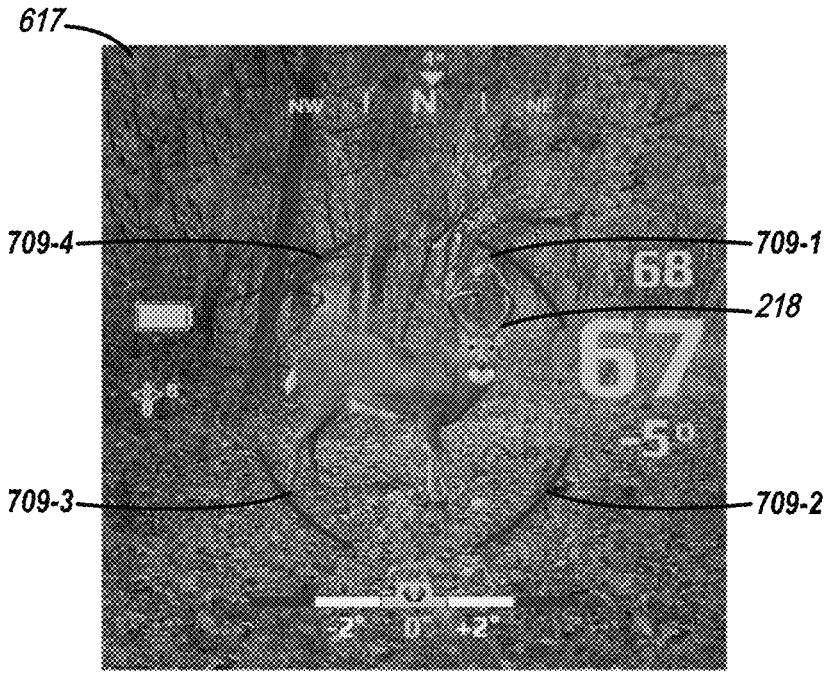
FIG. 7C illustrates an example of a user interface of the targeting system including an indication of unsteadiness.

FIG. 7B and FIG. 7C illustrate examples of a user interface 617 of the targeting system 102 including indications of unsteadiness. The targeting system 102 may present on the user interface 617 one or more indications for unsteadiness that are utilized to assist a user 501 to successfully strike a target 218 with an arrow 106.

An indication of unsteadiness can be represented by circular segments 709-1, 709-2, 709-3, and 709-4. With greater unsteadiness, as illustrated in FIG. 7C, the diameter of the circular segments 709-1, 709-2, 709-3, and 709-4 can increase and with less unsteadiness, as illustrated in FIG. 7B, the diameter of the circular segments 709-1, 709-2, 709-3, and 709-4 can decrease. For example, only a portion of target 218 is encompassed by the diameter of the circular segments 709-1, 709-2, 709-3, and 709-4 in FIG. 7B, while all of target 218 is contained within the diameter of the circular segments 709-1, 709-2, 709-3, and 709-4 in FIG. 7C.

A user 501 may be alerted, by the circular segments 709-1, 709-2, 709-3, and 709-4, that he is shaking and he may try to suppress his shaking. The user 501 will be able to verify that his shaking has lessened by the diameter of the circular segments 709-1, 709-2, 709-3, and 709-4 decreasing or the circular segments 709-1, 709-2, 709-3, and 709-4 disappearing.

The circular segments 709-1, 709-2, 709-3, and 709-4 are displayed as a dark shade in a greyscale in FIG. 7B and FIG. 7C. However, the circular segments 709-1, 709-2, 709-3, and 709-4, among other indicators, can be displayed in different shades or colors. For example, the circular segments 709-1, 709-2, 709-3, and 709-4 are displayed in white in FIG. 9B. In some examples, the circular segments 709-1, 709-2, 709-3, and 709-4 can be displayed in a particular shade or color to contrast against a background presented on the user interface 617.

Figure 8A:
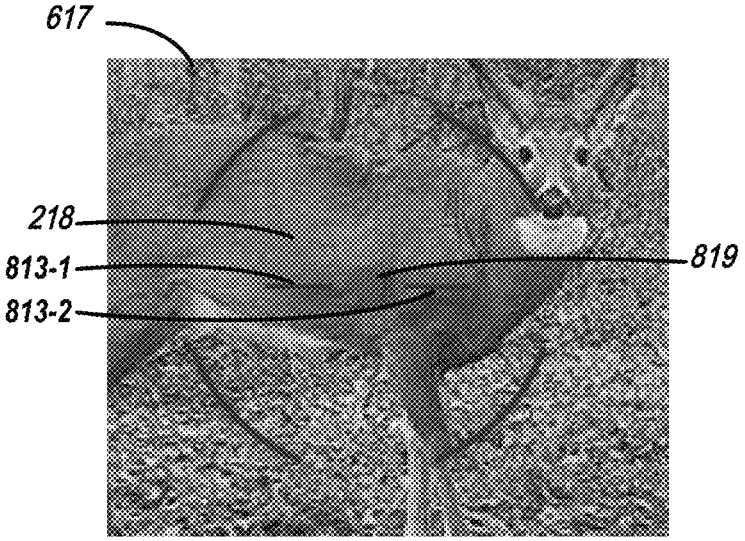
FIG. 8A illustrates an example of a user interface of the targeting system including an indication of level.
Figure 8B:
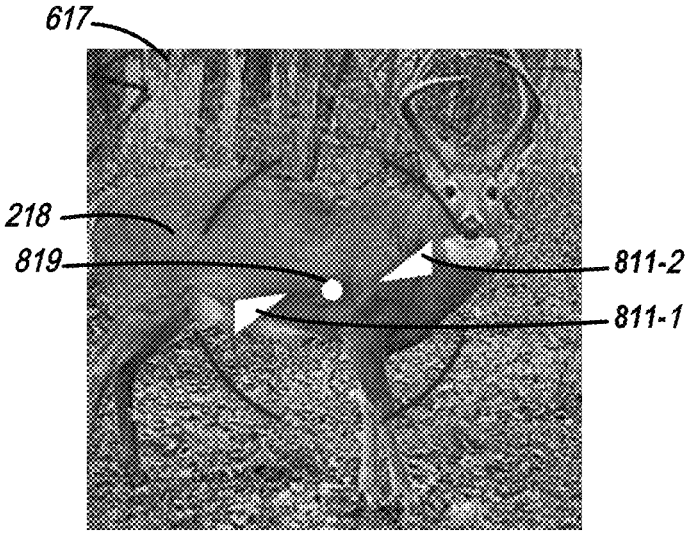
FIG. 8B illustrates an example of a user interface of the targeting system including an indication of roll.
Figure 8C:
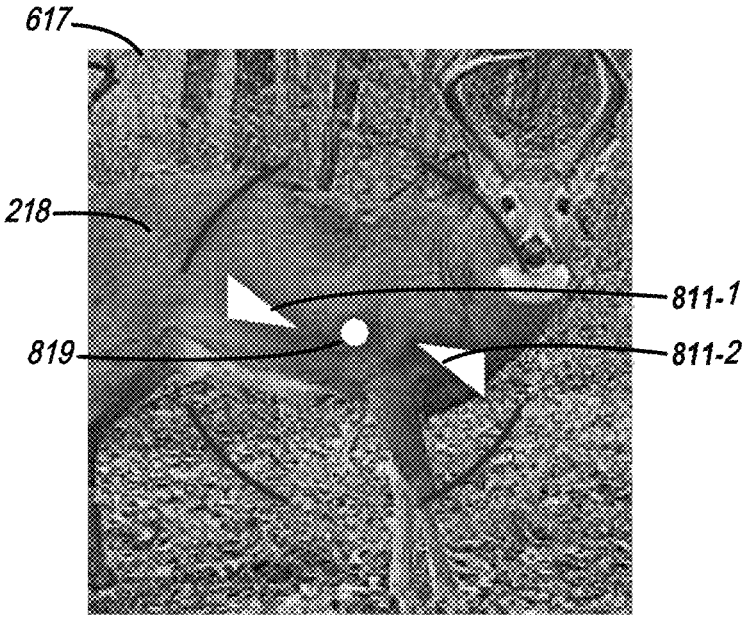
FIG. 8C illustrates an example of a user interface of the targeting system including an indication of roll.

FIG. 8A illustrates an example of a user interface 617 of the targeting system 102 including an indication of level. FIG. 8B and FIG. 8C illustrate examples of a user interface 617 of the targeting system 102 including indications of roll. The user interface 617 can display the target 218, an indication of level represented by one or more horizontal lines 813-1 and 813-2, and an aim point 819, among other indicators.

A user 501 can have right or left misses if the targeting system 102 is canted. Therefore, determining and displaying whether the targeting system 102 is level via the horizontal lines 813-1 and 813-2 can assist the operator with successfully striking the target 218. An indication of level can be represented by the horizontal lines 813-1 and 813-2 being centered on the user interface 617, as illustrated in FIG. 8A. An indication of roll can be represented by the canted triangles 811-1 and 811-2 being centered on the user interface 617, as illustrated in FIG. 8B and FIG. 8C. In some examples, the canted triangles 811-1 and 811-2 can be an additional indication of roll if the user interface 617 includes another indication of roll. As the user 501 rolls the targeting system 102 into a zero-degree position, one or more canted triangles, illustrated in FIG. 8B and FIG. 8C, can be replaced by the horizontal lines 813-1 and 813-2, which can signal to the user 501 that the targeting system 102 is in a level position.

The horizontal lines 813-1 and 813-2 are displayed as a dark shade in a greyscale in FIG. 8A. However, the horizontal lines 813-1 and 813-2, among other indicators, can be displayed in different shades or colors. For example, the horizontal lines 813-1 and 813-2 are displayed in white in FIG. 9A. In some examples, the horizontal lines 813-1 and 813-2 can be displayed in a particular shade or color to contrast against a background presented on the user interface 617.

As a user 501 rolls the targeting system 102 away from a zero-degree roll position, the canted triangles 811-1 and 811-2 have a greater offset from a horizontal axis with relatively greater roll. For example, if the targeting system 102 is canted to the user's left, a first canted triangle 811-1 on the user's left can be below a horizontal axis and a second canted triangle 811-2 on the user's right can be above the horizontal axis, as illustrated in FIG. 8B. As the targeting system 102 is rolled further to the user's left, the first canted triangle 811-1 and the second canted triangle 811-2 can move further from the horizontal access. The first canted triangle 811-1 positioned below the horizontal axis and the second canted triangle 811-2 positioned above the horizontal axis indicates to the user 501 that he should roll the targeting system 102 to his right to get the targeting system 102 to a level position.

If the targeting system 102 is canted to the user's right, a first canted triangle 811-1 on the user's left can be above a horizontal axis and a second canted triangle 811-2 on the user's right can be below the horizontal axis, as illustrated in FIG. 8C. As the targeting system 102 is rolled further to the user's right, the first canted triangle 811-1 and the second canted triangle 811-2 can move further from the horizontal access. The first canted triangle 811-1 positioned above the horizontal axis and the second canted triangle 811-2 positioned below the horizontal axis indicates to the user 501 that he should roll the targeting system 102 to his left to get the targeting system 102 to a level position.

The canted triangles 811-1 and 811-2 are displayed as white in FIG. 8B and FIG. 8C. However, the canted triangles 811-1 and 811-2, among other indicators, can be displayed in different shades or colors. In some examples, the canted triangles 811-1 and 811-2 can be displayed in a particular shade or color to contrast against a background presented on the user interface 617.

In a number of embodiments, the user interface 617 can display the aim point 819. The aim point 819 can be the location for which a distance is being calculated. The aim point can be displayed in the center of the user interface and the first canted triangle 811-1 can be separated from the second canted triangle 811-2 by the aim point 819.

Figure 9A:
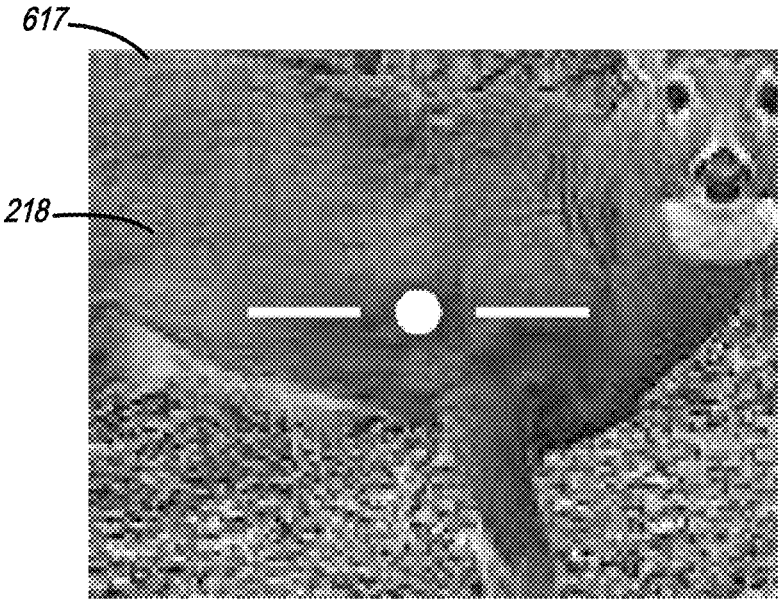
FIG. 9A illustrates an example of a user interface of the targeting system including an indication of steadiness.
Figure 9B:
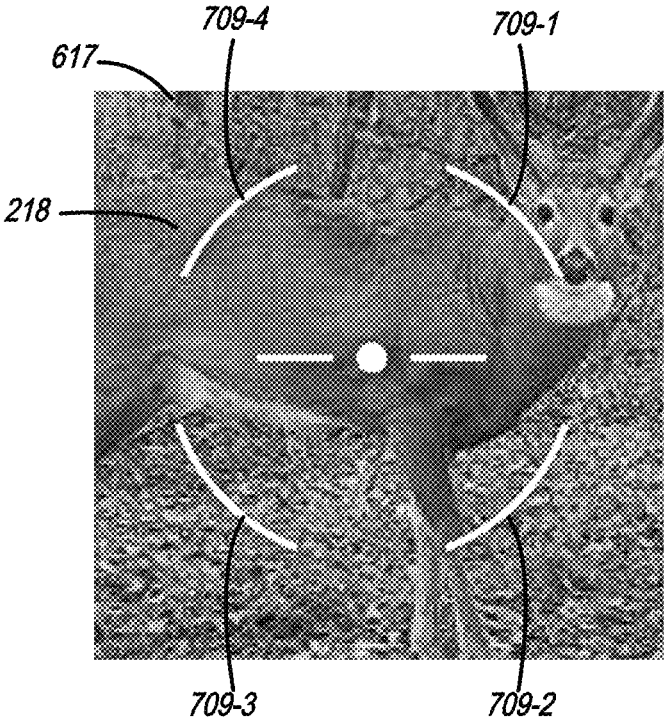
FIG. 9B illustrates an example of a user interface of the targeting system including an indication of unsteadiness.
Figure 9C:
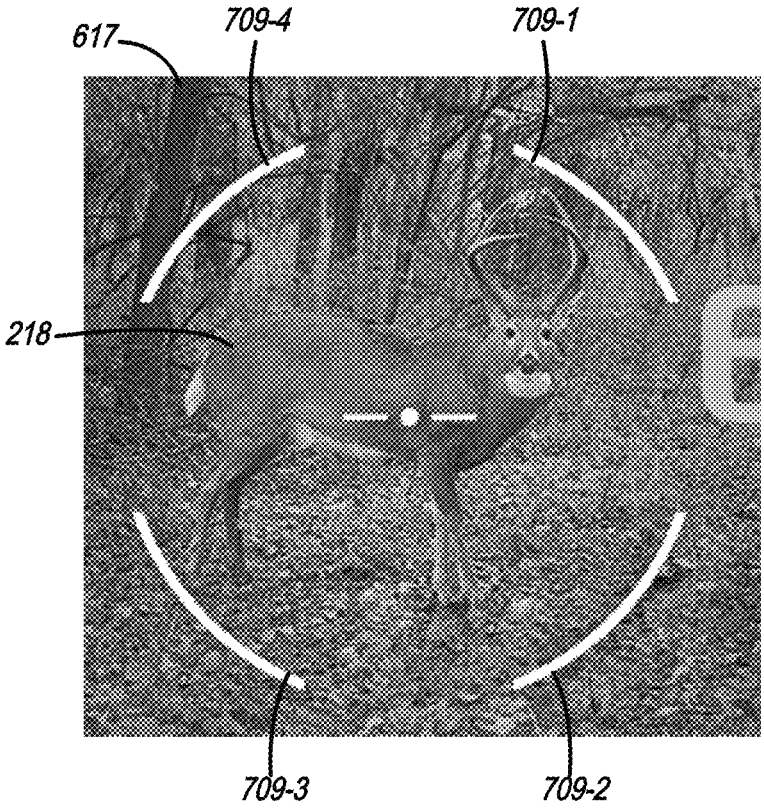
FIG. 9C illustrates an example of a user interface of the targeting system including an indication of unsteadiness.

FIG. 9A illustrates an example of a user interface 617 of the targeting system 102 including an indication of steadiness. FIG. 9B and FIG. 9C illustrate examples of a user interface 617 of the targeting system 102 including indications of unsteadiness. Even with the use of a sight or a display on a bow, an operator can miss a target 218 if the user 501 does not hold the targeting system 102 steady. Slight movement or rotation of the user 501 in the fully drawn position may cause misalignment of the bow and result in errant ranging or shot of the arrow 106. Therefore, determining and displaying whether the targeting system 102 is steady can assist the operator with successfully striking the target 218.

A user 501 can know if they are steady by the absence of indicators of unsteadiness. For example, if the user interface 617 does not show circular segments, as illustrated in FIG. 9A, the targeting system 102 is steady. A targeting system 102 can be steady when a user 501 is minimally shaking or not shaking. The absence of indicators of unsteadiness on the user interface 617 may reassure the user 501 that they are steady and will not miss due to unsteadiness.

An indication of unsteadiness can be represented by circular segments 709-1, 709-2, 709-3, and 709-4. With greater unsteadiness, as illustrated in FIG. 9C, the diameter of the circular segments 709-1, 709-2, 709-3, and 709-4 can increase and with less unsteadiness, as illustrated in FIG. 9B, the diameter of the circular segments 709-1, 709-2, 709-3, and 709-4 can decrease. For example, only a portion of target 218 is encompassed by the diameter of the circular segments 709-1, 709-2, 709-3, and 709-4 in FIG. 9B, while all of target 218 is contained within the diameter of the circular segments 709-1, 709-2, 709-3, and 709-4 in FIG. 9C.

A user 501 may be alerted, by the circular segments 709-1, 709-2, 709-3, and 709-4, that he is shaking and he may try to reduce his shaking. He will be able to verify that his shaking has lessened by the diameter of the circular segments 709-1, 709-2, 709-3, and 709-4 decreasing or the circular segments 709-1, 709-2, 709-3, and 709-4 disappearing.

The circular segments 709-1, 709-2, 709-3, and 709-4 are displayed as white in FIG. 9B and FIG. 9C. However, the circular segments 709-1, 709-2, 709-3, and 709-4, among other indicators, can be displayed in different shades or colors. For example, the circular segments 709-1, 709-2, 709-3, and 709-4 are displayed in a dark shade in a greyscale in FIG. 7B and FIG. 7C. In some examples, the circular segments 709-1, 709-2, 709-3, and 709-4 can be displayed in a particular shade or color to contrast against a background presented on the user interface 617.

The steadiness and level indicators described herein may take any form, shape, color, or arrangement. For instance, instead of utilizing horizontal lines 813-1, 813-2 to indicate levelness, one or more pins may be displayed or otherwise provided to assist in aiming. In one example, three vertical pins may be presented where one or more of the pins changes color, shape, intensity, or location to indicate bow attitude. If the top pin is flashing, the bow's top cam is tilted left. If the bottom pin is flashing, the bottom cam on the bow is tilted left. If the bow is level within tolerance, no pins are displayed. Similarly, icons, illuminated elements, and other symbology may be utilized to present the steadiness and level indicators.

Although specific embodiments have been illustrated and described herein, those of ordinary skill in the art will appreciate that an arrangement calculated to achieve the same results can be substituted for the specific embodiments shown. This disclosure is intended to cover adaptations or variations of one or more embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the one or more embodiments of the present disclosure includes other applications in which the above structures and methods are used. Therefore, the scope of one or more embodiments of the present disclosure should be determined with reference to the appended claims, along with the full range of equivalents to which such claims are entitled.

As used herein, "a number of" something can refer to one or more of such things. As will be appreciated, elements shown in the various embodiments herein can be added, exchanged, and/or eliminated so as to provide a number of additional embodiments of the present disclosure.

In the foregoing Detailed Description, some features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A targeting system operable to be used with a bow to assist an operator with striking a target with a projectile from the bow, the targeting system comprising:
- an accelerometer configured to generate acceleration data of the targeting system;
- an attitude sensor configured to generate attitude data of the targeting system;
- a display;
- a memory; and
- a processor coupled with the accelerometer, the attitude sensor, the display, and the memory, the processor configured to:
  - profile steadiness of the targeting system using the acceleration data;
  - profile roll of the targeting system using the attitude data;
  - present on the display based on the steadiness profile one of:
    - an indication of unsteadiness represented by circular segments of relatively greater diameter with relatively greater unsteadiness; and
    - an indication of steadiness represented by absence of the circular segments; and
  - present on the display based on the roll profile one of:
    - an indication of level represented by at least one horizontal line; and
    - an indication of roll represented by at least one canted triangle and absence of the at least one horizontal line.

2. The targeting system of claim 1, wherein the processor is configured to present on the display the indication of roll represented by the at least one canted triangle along an axis having a relatively greater offset from horizontal with relatively greater roll.

3. The targeting system of claim 2, wherein the processor is configured to present on the display the indication of roll represented by a first canted triangle and a second canted triangle along the axis having the relatively greater offset from horizontal with relatively greater roll.

4. The targeting system of claim 1, wherein the processor is configured to present on the display based on the roll profile one of:
- an additional indication of level represented by a marker being centered on a horizontal scale representing roll angle; and
- an additional indication of roll represented by the marker having a relatively greater offset from center with relatively greater roll on the horizontal scale.

5. The targeting system of claim 4, wherein the processor is configured to present on the display the horizontal scale including a numerical indication of degrees of roll.

6. The targeting system of claim 1, wherein the processor is configured to present on the display the indication of level represented by a first horizontal line separated from a second horizontal line by an aim point.

7. The targeting system of claim 1, wherein the processor is configured to present on the display at least one of: the circular segments, the at least one horizontal line, or the at least one canted triangle in a particular color to contrast against a background presented on the display.

8. The targeting system of claim 1, wherein the processor is configured to:

detect a number of shots taken using the acceleration data; and record the number of shots taken.

9. The targeting system of claim 8, wherein the processor is configured to present on the display the number of shots taken.

10. The targeting system of claim 8, wherein the processor is configured to notify a user in response to the number of shots taken reaching a threshold number of shots.

11. A targeting system operable to be used with a bow to assist an operator with striking a target with a projectile from the bow, the targeting system comprising:

an accelerometer configured to generate acceleration data of the targeting system;

an attitude sensor configured to generate attitude data of the targeting system;

a display;

a memory; and a processor coupled with the accelerometer, the attitude sensor, the display, and the memory, the processor configured to:

profile steadiness of the targeting system using the acceleration data;

profile roll of the targeting system using the attitude data;

present on the display based on the steadiness profile one of:

an indication of unsteadiness represented by circular segments of relatively greater diameter with relatively greater unsteadiness; and an indication of steadiness represented by absence of the circular segments; and present on the display based on the roll profile one of:

an indication of level represented by a marker being centered on a horizontal scale representing roll angle; and an indication of roll represented by the marker having a relatively greater offset from center with relatively greater roll on the horizontal scale.

12. The targeting system of claim 11, wherein the processor is configured to present on the display based on the roll profile an additional indication of level.

13. The targeting system of claim 11, wherein the processor is configured to present on the display the horizontal scale including a number of sections of roll angle ranges represented by shades or colors.

14. The targeting system of claim 13, wherein the processor is configured to present on the display a numerical value associated with a particular roll angle range.

15. A targeting system operable to be used with a bow to assist an operator with striking a target with a projectile from the bow, the targeting system comprising:

an attitude sensor configured to generate attitude data of the targeting system;

a display;

a memory; and a processor coupled with the attitude sensor, the display, and the memory, the processor configured to:

profile roll of the targeting system using the attitude data;

present on the display based on the roll profile:

an indication of level represented by at least one horizontal line; or an indication of roll represented by at least one canted triangle and absence of the at least one horizontal line; and an additional indication of level represented by a marker being centered on a horizontal scale representing roll angle; or an additional indication of roll represented by the marker having a relatively greater offset from center with relatively greater roll on the horizontal scale.

16. The targeting system of claim 15, wherein the processor is configured to present on the display a numerical degree value of the roll angle.

17. The targeting system of claim 15, comprising an accelerometer configured to generate acceleration data of the targeting system.

18. The targeting system of claim 17, wherein the processor is coupled with the accelerometer and is configured to:

profile steadiness of the targeting system using the acceleration data; and present on the display based on the steadiness profile an indication of unsteadiness or steadiness.

19. The targeting system of claim 15, wherein the processor is configured to present on the display a numerical value of zero below the marker being centered on the horizontal scale representing roll angle.

20. The targeting system of claim 15, wherein the processor is configured to present on the display a numerical value representing the roll angle below the marker having the relatively greater offset from center with relatively greater roll on the horizontal scale.

* * * * *